US007934942B2

(12) United States Patent
Pianezze

(10) Patent No.: US 7,934,942 B2
(45) Date of Patent: May 3, 2011

(54) QUICK RELEASE CONTACT DESIGNED TO FIT A TERMINAL BOARD, IN PARTICULAR FOR AN ELECTRONIC GAS IGNITER DEVICE FOR ELECTRIC HOUSEHOLD APPLICANCES

(75) Inventor: Daniele Pianezze, Cassano Magnago (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 16 days.

(21) Appl. No.: 12/375,720

(22) PCT Filed: Oct. 19, 2007

(86) PCT No.: PCT/IB2007/003137

§ 371 (c)(1),
(2), (4) Date: Jan. 30, 2009

(87) PCT Pub. No.: WO2008/047225

PCT Pub. Date: Apr. 24, 2008

(65) Prior Publication Data

US 2009/0258549 A1 Oct. 15, 2009

(30) Foreign Application Priority Data

Oct. 20, 2006 (IT) ..... TO2006A0757

(51) Int. Cl.
*H01R 12/00* (2006.01)

(52) U.S. Cl. ..... 439/441

(58) Field of Classification Search ..... 439/436–441
See application file for complete search history.

(56) References Cited

U.S. PATENT DOCUMENTS 2,725,544 A * 11/1955 Strange ..... 439/441
(Continued)

FOREIGN PATENT DOCUMENTS

EP 0878868 A2 11/1998
(Continued)

OTHER PUBLICATIONS

ISR for PCT/IB2007/003137 dated Jun. 17, 2008.

(Continued)

*Primary Examiner* — Ross N Gushi
(74) *Attorney, Agent, or Firm* — Lowe Hauptman Ham & Berner LLP

(57) ABSTRACT

A contact adapted to be used in conjunction with an electric wire prearranged with a tip connection terminal, of essentially rigid type, and including reception means of the terminal for at least one prevailing part of the length of the same in a direction of insertion (A), electric interface means between tip and contact, against which the terminal is in use abuttingly withheld, and elastic locking means prearranged between the reception means and the electric interface means so as to press in use with predetermined pressure the terminal against the electric interface means and at the same time cooperate with the terminal forming a first angle with the direction of insertion so as to prevent by seizing the extraction of the terminal from the reception means in the direction of insertion; wherein the elastic means and the reception means are shaped so as to allow a user to displace the terminal, against the bias of the elastic means, obliquely with respect to the interface means and to the direction of insertion (A), so as to determine between the elastic means and the terminal a second angle which does not allow the removal of the tip from the reception means along a direction of extraction (B) different from that of insertion (A).

11 Claims, 2 Drawing Sheets

U.S. PATENT DOCUMENTS

| | | | | |
|---|---|---|---|---|
| 3,646,582 | A | 2/1972 | Van Alphen et al. | |
| 3,652,811 | A * | 3/1972 | Barney | 200/5 EB |
| 4,256,358 | A | 3/1981 | Genz | |
| 4,350,839 | A * | 9/1982 | Lass | 174/661 |
| 4,397,514 | A * | 8/1983 | Durand et al. | 439/436 |
| 6,142,836 | A | 11/2000 | Deckmann et al. | |
| 6,741,453 | B1 | 5/2004 | Aleardi et al. | |
| 7,083,463 | B2 * | 8/2006 | Steinkemper et al. | 439/441 |
| 7,090,530 | B1 * | 8/2006 | Dibble | 439/441 |

FOREIGN PATENT DOCUMENTS

| | | | |
|---|---|---|---|
| SU | 1786570 | A2 | 1/1993 |
| WO | 0007263 | A1 | 2/2000 |

OTHER PUBLICATIONS

B.A. Sokolov et al., "Electrical Equipment—Installation Principles," Energiia, Moscow, 1967, Sixth Edition, pp. 456-457.

* cited by examiner

QUICK RELEASE CONTACT DESIGNED TO FIT A TERMINAL BOARD, IN PARTICULAR FOR AN ELECTRONIC GAS IGNITER DEVICE FOR ELECTRIC HOUSEHOLD APPLICANCES

RELATED APPLICATIONS

The present application is based on International Application Number PCT/IB2007/003137 filed Oct. 19, 2007, and claims priority from Italian Application Number TO2006A000757 filed Oct. 20, 2006, the disclosures of which are hereby incorporated by reference herein in their entirety.

TECHNICAL FIELD

The present invention relates to a quick release contact designed to fit a terminal board for electric household appliances, in particular an electric power terminal board for an electronic gas igniter device of a cooking range or barbecue. The invention further relates to a quick release wiring system including said contact and a terminal board for electric household appliances fitting the same.

BACKGROUND OF THE INVENTION

It is known from EP1101067B1 by the same Applicant an electronic gas igniter device in which there is integrated a box-like terminal board accommodating the electric power contacts therein, to which the terminals of an electric power cable are connected in use; according to such embodiment, electric power contacts of the traditional type are used, i.e. defined by plate elements formed by an electrically conducting material snappingly mounted on the terminal board and provided with a fastening screw for the terminals of the electric wires (usually three wires: live, neutral and ground) which form the electric power cable to be wired to the terminal board.

The above-described known device is more than satisfactory. Today, however, there are available power cables in which the electric wires are provided with rigid tip electric connection terminals, which have replaced the traditional cut and possibly soldered copper wire ends in many applications; such rigid tip terminals are formed by a conducting foil which is crimped onto the cut end of the electric wire, striped from the possible insulating sheath. Consequently, the terminal board are increasingly often equipped with a quick insertion wiring system based on the aforesaid tip terminals and on quick insertion contacts, in which the tip terminals may be manually inserted and locked in insertion position by means of elastic locking means carried by the contacts themselves.

However, in order to disconnect the electric wires from the corresponding contacts onto which they have been wired, today a tool must be used, e.g. a screwdriver, with which to operate on the elastic locking means to disengage them for a sufficient time so as to manually remove the terminals from the contacts along the same direction in which the manual insertion of each tip terminal was performed in the corresponding contact.

DISCLOSURE OF INVENTION

It is thus the object of the present invention to improve the wiring system in use today, e.g. in the terminal boards according to EP1101067B1, by providing a quick insertion contact which concurrently allows to also perform a quick manual release of the electric wire without requiring the use of tools, while ensuring low production and assembly costs, small dimensions and high reliability.

The present invention thus relates to a quick release contact adapted to be used in conjunction with an electric wire prearranged with an essentially rigid tip connection terminal, for example of the type used in the power cables of terminal boards for electric household appliances, in particular for the powering of an electronic gas igniter device, as defined in claim 1.

Not unlike the quick insertion contacts of the previously described known type, the quick release contact according to the invention comprises reception means of the tip terminal for at least one prevailing part of the length of the same in a direction of insertion, electric interface means between tip and contact, against which the tip terminal is abuttingly withheld in use, and elastic locking means arranged between the reception means and the electric interface means so as to press in use with predetermined pressure the tip terminal against the electric interface means and at the same time cooperate with the tip terminal forming a first angle with the direction of insertion so as to prevent, by seizing, the extraction of the terminal from the reception means in the direction of insertion.

According to an aspect of the invention, the elastic means and the reception means are shaped so as to allow a user to displace the tip terminal, against the bias of the elastic means, obliquely with respect to the interface means and to the direction of insertion, so as to determine between the elastic means and the direction of insertion a second angle such that it does not allow the elastic means to lock the tip terminal and simultaneously allows its removal from the reception means along a direction of extraction different from the direction of insertion.

In particular, it is sufficient for the user to apply a transverse traction to the direction of insertion on said electric wire prearranged with said tip terminal connected thereto to produce a flexion of the elastic means so that these are taken to a configuration in which they form the aforesaid second angle with the direction of insertion.

According to another aspect of the invention, the first angle is greater in absolute value than the second angle, to allow a relatively sharp edge of the elastic means to at least superficially cut into said tip terminal when a flexible tongue defining the aforesaid elastic means forms with the direction of insertion the first angle; and to allow the same edge to slide on the tip terminal when the flexible tongue forms the second angle with the direction of insertion.

In this manner, it is possible for the user (or an operator), for example while wiring or disassembling a terminal board of an electric household appliance, to wire the electric wires of the power cable onto the corresponding contacts of the terminal board very easily without tools simply by inserting the tip terminals in specific holes or passages of the contacts themselves and, subsequently, to remove the electric wires from the terminals with equal ease and again without tools, simply by orienting the tip terminals inside the holes or passages in a second direction, oblique to the direction of insertion, so as to make the tongues fitting each contact bend, and then remove the terminals along such second direction.

Therefore, the invention further relates to a wiring system based on electric wires provided with tip terminals, and to a terminal board, including the aforesaid contacts.

In order to further improve the performances of the contact and of the wiring system of the invention, the tongue is formed by a different material from the rest of the contact, e.g. in steel (while the rest of the contact is formed in a copper alloy, typically brass), and is integrally mounted on the rest of the contact by insertion on a first wing portion of the contact and then by crimping it to the same.

BRIEF DESCRIPTION OF THE DRAWINGS

Further features and advantages of the invention will be apparent in the following description of a non-limitative embodiment thereof, with reference to the figures in the accompanying drawings, in which.

BEST MODE FOR CARRYING OUT THE INVENTION

Figure 1:
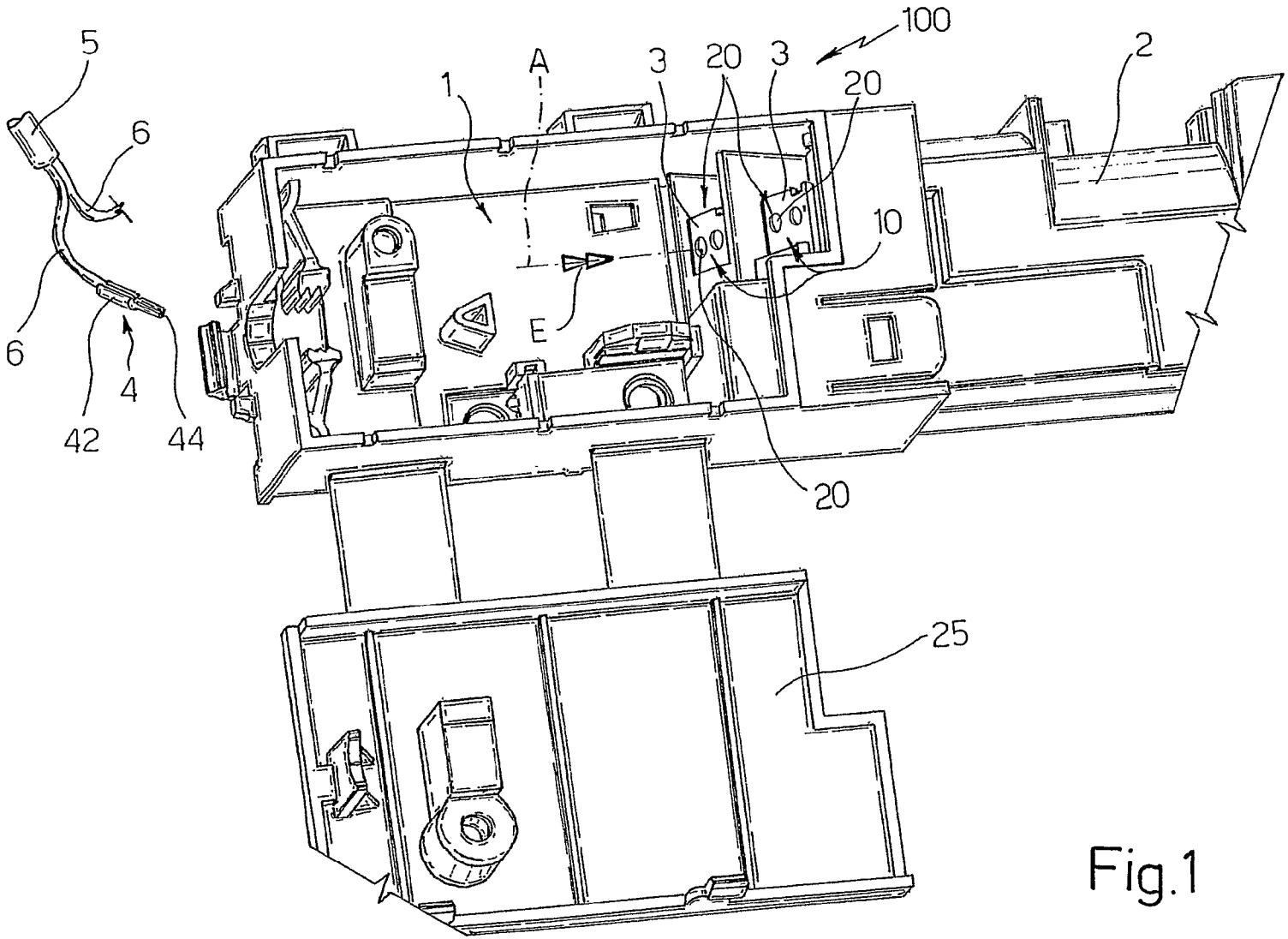
FIG. 1 shows a perspective three-quarters view from the top of an electronic gas igniter device integrating a terminal board made according to the invention, because it incorporates a pair of power contacts made according to the dictates of the invention.
Figure 3:
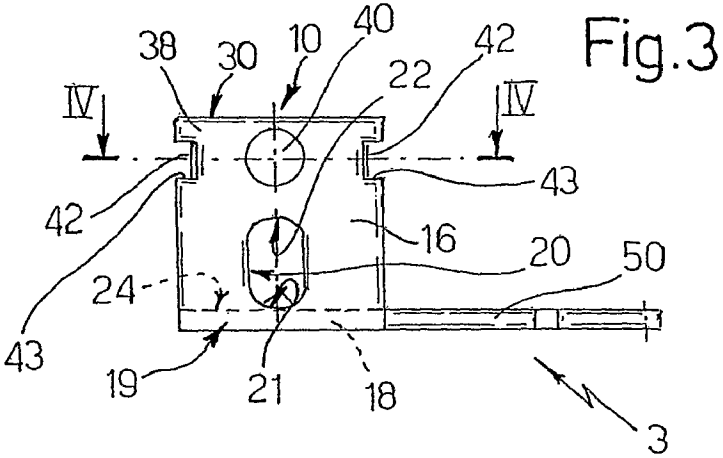
FIGS. 2, 3 and 5 show on enlarged scale respective elevation views of one of the contacts of the terminal board in FIG. 1.

With reference to FIG. 1, numeral 1 shows as a whole a terminal board for an electric household appliance, in particular for electrically powering an electronic gas igniter device 2 of a known type, possibly integrated with the terminal board 1, as in the illustrated non-limitative example, and designed to fit a cooking range or a barbecue, known and not shown for the sake of simplicity.

The terminal board 1 comprises a pair of power contacts 3 arranged in a known manner and made according to the invention so as to be adapted to allow both the rapid insertion and release without tools into/from corresponding tip terminals 4 (only one of which is shown for the sake of simplicity), of an essentially rigid type and known as a whole, e.g. of the type used in a power cable 5 for terminal boards 1, consisting of a plurality of insulated electric wires 6 with a cut free end onto each of which a tip terminal 4 is crimped in a known manner.

Figure 5:
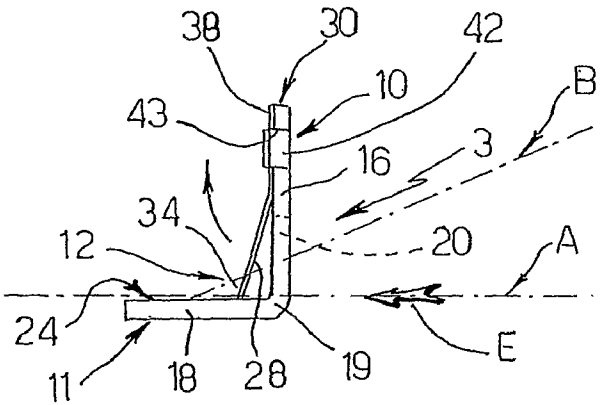
Figure 2:
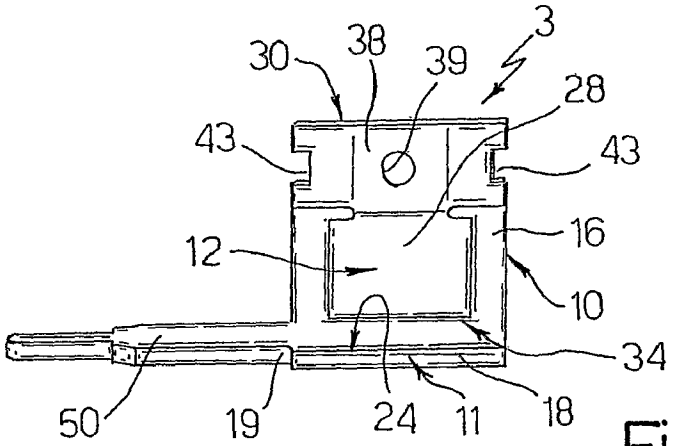
Figure 4:
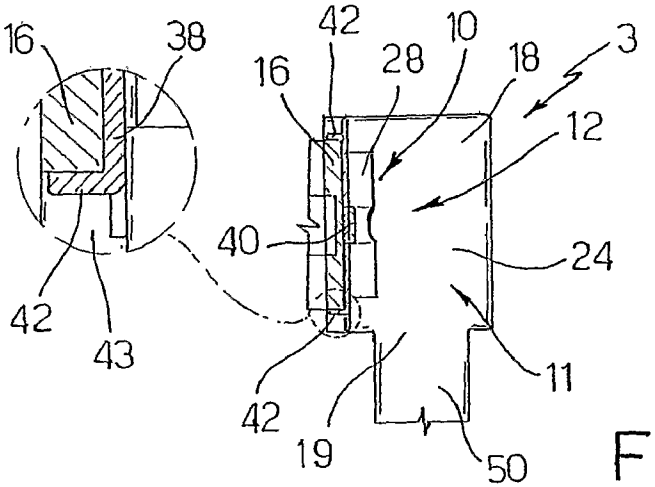
FIG. 4 shows a section view taken along a plotting line IV-IV of the contact shown in FIG. 3.

With reference now to FIGS. 2 to 5, each contact 3 comprises: reception means 10 of the tip terminal 4 for at least one prevailing part of the length of the same in a direction of insertion A, shown by the corresponding axis in FIG. 5; electric interface means 11 between tip terminal 4 (hereinafter also named "tip 4" or "terminal 4", for the sake of brevity) and contact 3, against which the tip terminal 4 is abuttingly withheld in use, in an essentially known manner; and elastic locking means 12 (FIG. 5) arranged between the reception means 10 and the electric interface means 11, so as to press in use with predetermined pressure (according to a known configuration not shown for the sake of simplicity) the tip terminal 4 against the electric interface means 11 and at the same time to cooperate with the tip terminal 4 forming a first angle (e.g. an acute angle either equal or close to 45°) with the direction of insertion so as to prevent by seizing (as will be seen in greater detail below) the extraction of the terminal 4 from the reception means 10 in the direction A of insertion.

According to the main aspect of the invention, the elastic means 12 and the reception means 10 are shaped so as to allow a user or operator, e.g. in charge of wiring/dissembling the terminal board 1, to displace the tip terminal 4 against the bias of the elastic means 12, obliquely with respect to the interface means 11 and to the direction of insertion A, so as to determine between the elastic means 12 and the direction of insertion A a second angle so as to prevent the elastic means 12 from locking the tip terminal 4 and simultaneously to allow its removal from the reception means 10 along a direction of extraction B, shown by a second axis in FIG. 5, different from the direction of insertion A.

In particular, the elastic means 12 and the reception means 10 are shaped so as to allow in use the aforesaid user/operator to displace the tip terminal 4 obliquely to the interface means 10 and to the direction of insertion A, e.g. with orientation coinciding with the direction of extraction B, by applying a transverse traction to the direction of insertion A on the electric wire 6 prearranged with the tip terminal 4 connected thereto integral with the free end intended to be cabled to the terminal board 1.

According to the non-limitative embodiment shown, the reception means 10 and the electric interface means 11 consist, respectively, in a first wing 16 and a second wing 18 of a conducting element 19 constituted by a metallic plate bent as an L to form the first wing 16 and second wing 18, which are arranged reciprocally perpendicularly; in particular, the second wing 18 is adapted in use to be arranged in parallel with the direction of insertion A in a corresponding seat 20 of the terminal board 1 for the contact 3, while the first wing 16 is adapted to be arranged upstream of the second wing 18 in the direction of insertion A, with reference to a direction of insertion of the tip terminal 4 in the reception means 10, indicated by the arrow with reference E in FIGS. 1 and 5, so that in use it conceals the wing 18 on the inner side of the terminal board 1 (FIG. 1).

In the case in point, the first wing 16 is provided with a through perforation 20 (FIG. 3) dimensioned so as to allow the passage of the tip terminal 4 through it; such through perforation 20 consists in a slot of predetermined length oriented perpendicularly to the laying plane of the second wing 18; the slot 20 presenting lengthwise a first end 21 and a second end 22, opposite to 21.

The first end 21 is flushed to a face 24 of the second wing 18 facing towards the first wing 16 (in use towards the mouth of the terminal board 1 intended to be closed by a lid 25) and the second end 22 is made at a distance from the face 24 so as to allow the tip terminal 4 to take, when it is inserted by at least aforesaid prevalent part of its length within the slot 20, an oblique position with respect to the second wing 18, in which a first end 44 (FIG. 1) of the tip terminal 4 rests on the face 24 and a second opposite end 42 of the tip terminal 4, facing the electric wire 6, is laterally abutting against the end 22 of the slot 20.

For this purpose, the elastic means 12 consist in a flexible tongue 28 integrally carried by the first wing 16 and which protrudingly extends obliquely towards the second wing 18 from a portion of the first wing 16 adjacent to a superior (i.e. which is closest to the mouth of the terminal board 1 in use) free end 30 of the same, facing opposite band with respect to the second wing 18.

The tongue 28 extends to a distance from the face 24 smaller than the minimum transverse dimensions of the tip terminal 4, so as to be adapted to interfere with the tip terminal 4 when this is inserted in said through perforation defined by the slot 20 in the direction of insertion A to be consequently bent by the tip 4 and thus induced to take the aforesaid mentioned first angle with direction of insertion A.

It is thus apparent that when the tip 4 takes, in consequence of the aforesaid transverse traction by the user/operator, an oblique configuration with respect to the wing 18, in which its orientation coincides with that of the direction of extraction B, it will produce a flexion in the sense of the curved arrow (FIG. 5) of the tongue 28 (to induce it to take the mentioned predetermined second angle with direction A) much greater than that produced by the insertion along the direction A of the terminal 4 in the slot 20, at the end 21. This will thus determine a value of the first angle greater in absolute value to that of the second angle.

According to an aspect of the invention, the tongue 28 presents a free end arranged immediately adjacent to the face 24 delimited by a relatively sharp edge 34 adapted to at least superficially cut into the tip terminal 4 when the flexible tongue 20 forms the aforesaid first angle with the direction of insertion A. Furthermore, the edge 34 is shaped so that, conversely, when the flexible tongue 28 forms the aforesaid second angle with the direction A, the edge 34 is adapted to slide relative to the tip terminal 4.

According to a preferred aspect of the invention, the flexible tongue 28 is made of steel (e.g. AISI spring steel), while the electrically conductive metallic plate 19 is made of a copper alloy, e.g. brass; the flexible tongue 28 is then integrally fixed and crimped to the first wing 16 by means of a claw-shaped attachment portion 38 thereof.

In particular, the claw-shaped attachment portion 38 comprises: an intermediate part provided with a through hole 39 (FIG. 2) engaged by a boss 40 carried by the first wing 16 and which has been riveted into the hole 39; and two side parts provided with plastically deformable fins 42, which are folded within corresponding side grooves 43 of the first wing.

Finally, the second wing 18 is laterally provided with a foil shaped assembly appendix 50 adapted to be inserted in use in a seat of a support, in the case in point in a slot (not shown) of the corresponding seat 20 of the terminal board 1.

On the basis of the description, it is apparent that for each seat 20 of the terminal board 1 a tip 4 of the electric wire 6 intended to be wired in such seat 20, and a contact 3 mounted inside such seat 20 in a known manner, e.g. by snapping assembly of wing 18, form a toolless rapid release wiring system, indicated as a whole by numeral 100 in FIG. 1, indeed comprising an essentially rigid tip connection terminal 4 integrally arranged on an end of an electric wire 6 and a contact 3 according to the foregoing description.

In this manner, the objects of the invention are reached by means of a simple, reliable and relatively cost-effective structure.

The invention claimed is:

1. A quick release contact configured to be used with an electric wire prearranged with a tip of an essentially rigid type connection terminal, the contact comprising:

an electrically conductive metallic plate bent perpendicular to form first and second wings perpendicular to each other, the first wing having a through slot dimensioned so as to allow passage of a tip terminal through the slot in a direction of insertion from an outer surface of the first wing to an inner surface of the first wing, the second wing parallel to a direction of insertion of the tip terminal, and the first wing upstream of the second wing in the direction of insertion, wherein the slot has a predetermined length oriented perpendicularly to a plane of the second wing, the slot presenting lengthwise a first and a second end, the first end flush to a face of the second wing facing towards the first wing; and a flexible tongue attached to the inner surface of said first wing and extending obliquely towards an inner surface of the second wing, the flexible tongue having a free end for locking the tip terminal and preventing extraction of the tip terminal from the first wing, the free end of the flexible tongue configured to press, with predetermined pressure, the tip terminal against the inner surface of the second wing, and wherein the flexible tongue and first wing are shaped so as to allow a user to displace the tip terminal against the bias of the flexible tongue, so as to determine between the flexible tongue and the direction of insertion an extraction angle such as to release the tip terminal from the flexible tongue and allow removal of the tip terminal from the first wing along a direction of extraction different from the direction of insertion;

wherein said flexible tongue includes a claw-shaped attachment portion further comprising two side parts provided with plastically deformable fins folded within respective side grooves of the first wing.

2. A contact according to claim 1, wherein the first wing and the flexible tongue are shaped so as to allow a user to displace the tip terminal obliquely in the direction of insertion by applying a transverse traction, in the direction of insertion, on said electric wire attached to said tip terminal.

3. A quick release wiring system comprising a tip connection terminal of essentially rigid type integrally formed on an end of an electric wire and a contact according to claim 1.

4. A terminal board for an electric household appliance comprising a plurality of contacts according to claim 1.

5. A contact according to claim 1, wherein said free end of the flexible tongue extends to a distance from the inner face of the second wing so as to interfere with the tip terminal when inserted in said slot.

6. A contact according to claim 1, wherein the free end of the flexible tongue is delimited by a relatively sharp edge configured to at least superficially cut into said tip terminal when the tip terminal is inserted into the slot.

7. A contact according to claim 6, wherein said flexible tongue forms a predetermined angle with said direction of insertion when said relatively sharp edge slides on said tip terminal.

8. A contact according to claim 5, wherein said flexible tongue is made of a steel, while said electrically conductive metallic plate is made of a copper alloy; and said flexible tongue fixed and crimped to the first wing.

9. A contact according to claim 8, wherein said claw-shaped attachment portion includes an intermediate part provided with a through hole engaged by a boss carried by the first wing and riveted into the through hole.

10. A contact according to claim 5, wherein said second wing includes a laterally disposed foil shaped assembly for inserting into a support seat.

11. A quick release contact configured to be used with an electric wire prearranged with a tip of an essentially rigid type connection terminal, the contact comprising:

an electrically conductive metallic plate bent perpendicular to form first and second wings perpendicular to each other, the first wing having a through slot dimensioned so as to allow passage of a terminal tip through the slot in a direction of insertion from an outer surface of the first wing to an inner surface of the first wing, the second wing parallel to a direction of insertion of the tip terminal, and the first wing upstream of the second wing in the direction of insertion; and a flexible tongue attached to the inner surface of said first wing and extending obliquely towards an inner surface of the second wing, the flexible tongue having a free end for preventing extraction of the tip terminal from the first wing, the free end of the flexible tongue configured to press, with predetermined pressure, the tip terminal against the inner surface of the second wing, said flexible tongue is fixed and crimped to the first wing by a claw-shaped attachment portion;

wherein said flexible tongue includes a claw-shaped attachment portion further comprising two side parts provided with plastically deformable fins folded within respective side grooves of the first wing.

* * * * *